US005866975A

United States Patent [19]

Gärtner et al.

[11] Patent Number: 5,866,975

[45] Date of Patent: Feb. 2, 1999

[54] LOW-TEMPERATURE CATHODE HAVING AN EMISSIVE NANOSTRUCTURE

[75] Inventors: Georg Gärtner; Peter Geittner, both of Aachen; Hans-Jürgen Lydtin, Stolberg, all of Germany

[73] Assignee: U.S. Philips Corporation, New York, N.Y.

[21] Appl. No.: 643,089

[22] Filed: Apr. 30, 1996

[30] Foreign Application Priority Data

May 2, 1995 [DE] Germany ..... 195 15 596.3

[51] Int. Cl.[6] ..... H01J 1/14

[52] U.S. Cl. ..... 313/346 DC; 313/346 R; 313/337; 313/270

[58] Field of Search ..... 313/346 R, 346 DC, 313/270, 234, 337

[56] References Cited

U.S. PATENT DOCUMENTS 4,160,191 7/1979 Hausfeld ..... 313/491

4,810,926 3/1989 Schwarz et al. ..... 313/346 DC 5,666,022 9/1997 Deckers et al. ..... 313/346 DC

*Primary Examiner*—Ashok Patel

*Attorney, Agent, or Firm*—Robert J. Kraus

[57] ABSTRACT

An electric discharge tube or discharge lamp, in particular a flat-panel display screen, includes one or more low-temperature cathodes having a holder, which, optionally, is provided with a heating or cooling element, a conductive bottom layer which is applied to the holder, optionally a substrate with dispenser material, and a top coating of ultrafine particles having a nanostructure. The top coating has a surface layer consisting of an emitter complex formed from an emission material comprising several components. The cathodes have a high reliability and a long service life under a normal working load. The emission is stable, which contributes to a constant picture quality throughout the life of the discharge lamp or discharge tube. The discharge tubes or discharge lamps in accordance with the invention have short switching times and the advantage that their construction has been simplified and that their energy consumption is low. A method of manufacturing low-temperature cathodes in accordance with the invention is described.

7 Claims, 2 Drawing Sheets

LOW-TEMPERATURE CATHODE HAVING AN EMISSIVE NANOSTRUCTURE

BACKGROUND OF THE INVENTION

The invention relates to an electric discharge tube or discharge lamp comprising one or more low-temperature cathodes, to a flat-panel display screen comprising one or more low-temperature cathodes, and to a low-temperature cathode and a method of manufacturing said low-temperature cathode.

Conventional display screens comprise an electric discharge tube which operates according to the cathode ray tube principle. This means that electrons are accelerated from a cathode, then they are deflected and, finally, they impinge on a curved fluorescent screen. Such discharge tubes require a large construction depth or a strong curvature of the display screen, otherwise the difference in distance from the electron source to the front side of the display screen would cause the signs to be displayed in focus in the center yet distorted at the edge.

Also flat-panel display screens have been commercially available for a number of years. In the development of flat-panel display screens, various principles are in competition with each other. The present invention relates, inter alia, to flat-panel display screens having active systems, in which, unlike liquid-crystal display screens, the display screen is not operated by means of ambient light, but is self-luminescent. This type of flatpanel display screens includes plasma-display screens and flat-panel display tubes.

Flat-panel display screens were developed for three market segments, i.e. office automation, audio/video technology and navigation and entertainment. In the field of office automation, reference must be made, in particular, to mobile applications which range from the notebook computer, Personal Digital Assistant, fax machine to the mobile telephone. In the field of audio and video, the flat-panel display screens are intended not only for use in camcorders but also in television receivers and monitors. The third field of application comprises flat-panel display screens which are to be used as monitors for navigation systems in cars and aircraft, but also as displays for electronic games.

A drawback of the cathode ray tube is that it takes up a lot of space. This is caused by the fact that all electrodes originate from a single cathode and are brought, via deflection units, to the desired spot on the display screen, so that they are responsible for all pixels. The cathodes of these conventional cathode ray tubes are hot cathodes ("thermionic cathodes"). The generation of electron beams is based on thermionic emission. The conventional, heatable cathode is made, for example, of a small nickel tube on an end face of which there is provided an oxide layer, for example of barium oxide, which emits electrons very readily. The heating wire which is embedded in said nickel tube so as to be insulated, raises the temperature of the cathode to approximately 1200° Kelvin (900° C.), so that electrons are "evaporated out" of the oxide layer in the vacuum of the tube.

In the case of the flat display screens, however, the electrons are generated in a number of wire cathodes, flat-strip cathodes or in planar field emitters. Consequently, each cathode is responsible only for a small number of pixels.

For all types of flat-panel display screens, the manufacture of appropriate cathodes constitutes a key technology. A lot of effort has already been put into the development of cathodes and novel cathode materials suitable for the flat-panel display screen technology. The use of extended wire cathodes, flat-strip cathodes or planar cathodes in flat-panel display screens, instead of the conventional punctiform cathode, results in a much lower emission. Since the conventional hot cathodes have the disadvantage that the cathode must be maintained at a constant high temperature, which involves an additional thermal-energy consumption, one of the above-mentioned developments relates to the manufacture of cold cathodes. Hitherto, developments in the field of cold cathodes include, for example, microtip emitters or semiconductor emitters (AC-cathodes=avalanche cold cathodes). A drawback of said microtip emitter cathodes is the burning-out of single microtips and the high current noise of the individual microtips. AC-cathodes have the disadvantage that their emission is extremely localized, requiring a high positional accuracy of the cathodes.

SUMMARY OF THE INVENTION

Consequently, it is an object of the invention to provide an electric discharge tube or discharge lamp comprising an improved cathode. A further aspect of the invention relates to a flat-panel display screen having an improved cathode, and to an improved cathode.

In accordance with the invention, this object is achieved by an electric discharge tube or discharge lamp including one or more low-temperature cathodes comprising a holder, which optionally, is provided with a heating or cooling element, a conductive bottom layer which is applied to the holder, optionally a substrate with dispenser material, and a top coating of ultrafine particles having a nanostructure, the top coating having a surface layer consisting of an emitter complex formed from an emission material comprising several components.

Such discharge tubes or discharge lamps are characterized by a high reliability and a long service life under a normal working load. The emission is stable, which contributes to a constant picture quality during the entire life of the discharge lamp or discharge tube. The discharge tubes or discharge lamps in accordance with the invention have short switching times, and they have the advantage that their construction has been simplified and that their energy consumption is low.

A preferred embodiment of the discharge tubes or discharge lamps in accordance with the invention is characterized in that it comprises a grid-control electrode.

Such a grid-control electrode enables the emission of one of a number of low-temperature cathodes in accordance with the invention, or single surface segments of a low-temperature cathode, to be controlled by changing the field strength.

A flat-panel display screen in accordance with the invention has one or more low-temperature cathodes which comprise a holder, which optionally, includes a heating or cooling element, a conductive bottom layer which is applied to the holder, a substrate with dispenser material, and a top coating of ultrafine particles having a nanostructure, the top coating having a surface layer consisting of an emitter complex formed from an emission material comprising several components.

A flat-panel display screen in accordance with the invention is easy to manufacture because its production does not require sub-micron lithography. Such a flat-panel display screen has a low energy consumption, is brighter and can be operated within a wider temperature range of the ambient temperature, i.e. from −30° C. to 100° C. In addition, it exhibits a very good resolution and can suitably be used for black/white display screens and color display screens.

A low-temperature cathode in accordance with the invention comprises a holder, which includes a heating or cooling element, a conductive bottom layer which is applied to the holder, a substrate with a dispenser material, and a top coating of ultrafine particles having a nanostructure, the top coating having a surface layer consisting of an emitter complex formed from an emission material comprising several components.

Such low-temperature cathodes have the following advantages:

a low work function on the macroscopic surface a high density of "crystallite microtips" made from ultrafine particles a small radius of curvature of the emitting crystallite microtips, which precludes burning out of said microtips a high electroconductivity and a good current carrying capacity insensitivity to contamination a high degree of uniformity a high emission reserve upon ion bombardment.

In accordance with a preferred embodiment of the low-temperature cathode in accordance with the invention, the low-temperature cathode is characterized in that it can suitably be used at an operating temperature in the range between 20° C. and 500° C.

The low-temperature cathode in accordance with the invention can be used, on the one hand, as a real cold cathode and is very suitable as a cold, controllable electron emitter for flat displays. On the other hand, the threshold field strength can be reduced almost to zero by moderately heating to an operating temperature in the range from 200° C. to 300° C. At 500° C., that is 250° C. below the operating temperature of oxide wire cathodes, a current density of 0.1 $A/cm^2$ required for line cathodes is already attained.

Preferably, the emission material comprises a first component, which contains metals, in particular refractory metals and the alloys thereof, a second component, which contains scandium, yttrium, lanthanum, the lanthanides or actinides and/or their compounds, in particular their oxides, and/or a third component which contains alkaline earths and/or their compounds.

In the formation process, an emitter complex having a very low work function is formed from these components.

In accordance with a particularly preferred embodiment, the first component of the emission material is tungsten, the second component consists of oxidic compounds of scandium and the third component consists of oxidic compounds of barium.

This composition of the emission material resulted in the lowest work-function values.

Preferably, the components of the emission material are individually or jointly included in the bottom layer and/or substrate and/or top coating. In this manner, a reservoir of emission material for producing the emitter complex can be formed.

Preferably, the emitter complex formed has a work function<2.8 eV.

A very advantageous low-temperature cathode is characterized in that the ultrafine particles have a grain size in the range from 1 to 100 nm. Such cathodes can very suitably be used as field emitters because they have surface structures and surface modulations of particles whose diameter ranges from 1 to 100 nm, hence relatively small radii of curvature in a dense particle and microtip distribution on the macroscopic surface.

Preferably, the nanostructure of the top coating is nanocrystalline or nanoamorphous and, if necessary, nanoporous, and the size of the structure ranges from 1 to 1,000 nm.

The invention further aims at providing a method of manufacturing the low-temperature cathodes in accordance with the invention.

This object is achieved by a method in accordance with the invention, in which, in a first step, a semi-finished product is manufactured which comprises a holder on which a conductive bottom layer is provided, if necessary a substrate with a dispenser material, and a top coating of ultrafine particles having a nanostructure, said semi-finished product containing the components of the emission material either separately or jointly in the bottom layer and/or the substrate and/or the top coating, and, in a second step, the emitter complex is formed as a surface layer on the top coating.

By virtue of this method, low-temperature cathodes emitting very uniformly are obtained, whose emission properties, in particular the cold emission, exhibit a small spread.

Preferably, the formation takes place at a temperature $\geq$800° C. in an ultra-high vacuum or high vacuum at a residual gas pressure, while applying an electric field.

In a particularly preferred embodiment, the residual gas pressure is $\leq 10_{-3}$ mbar and the residual gas contains noble gases, nitrogen, hydrogen and/or oxygen, which each have a partial pressure $<10^{-5}$ mbar.

In a further preferred method, the formation process consists in sintering at a temperature >500° C in a vacuum or in a gas atmosphere containing noble gases, nitrogen, hydrogen and/or oxygen.

Preferably, the top coating of ultrafine particles having a nanostructure is manufactured by means of laser-ablation deposition.

In a particularly preferred method, said laser-ablation deposition takes place at a pressure below atmospheric. This results in a very thin, uniform top coating.

These and other aspects of the invention will be apparent from and elucidated with reference to the embodiments described hereinafter.

DESCRIPTION OF THE PREFERRED EMBODIMENTS

Figure 1:
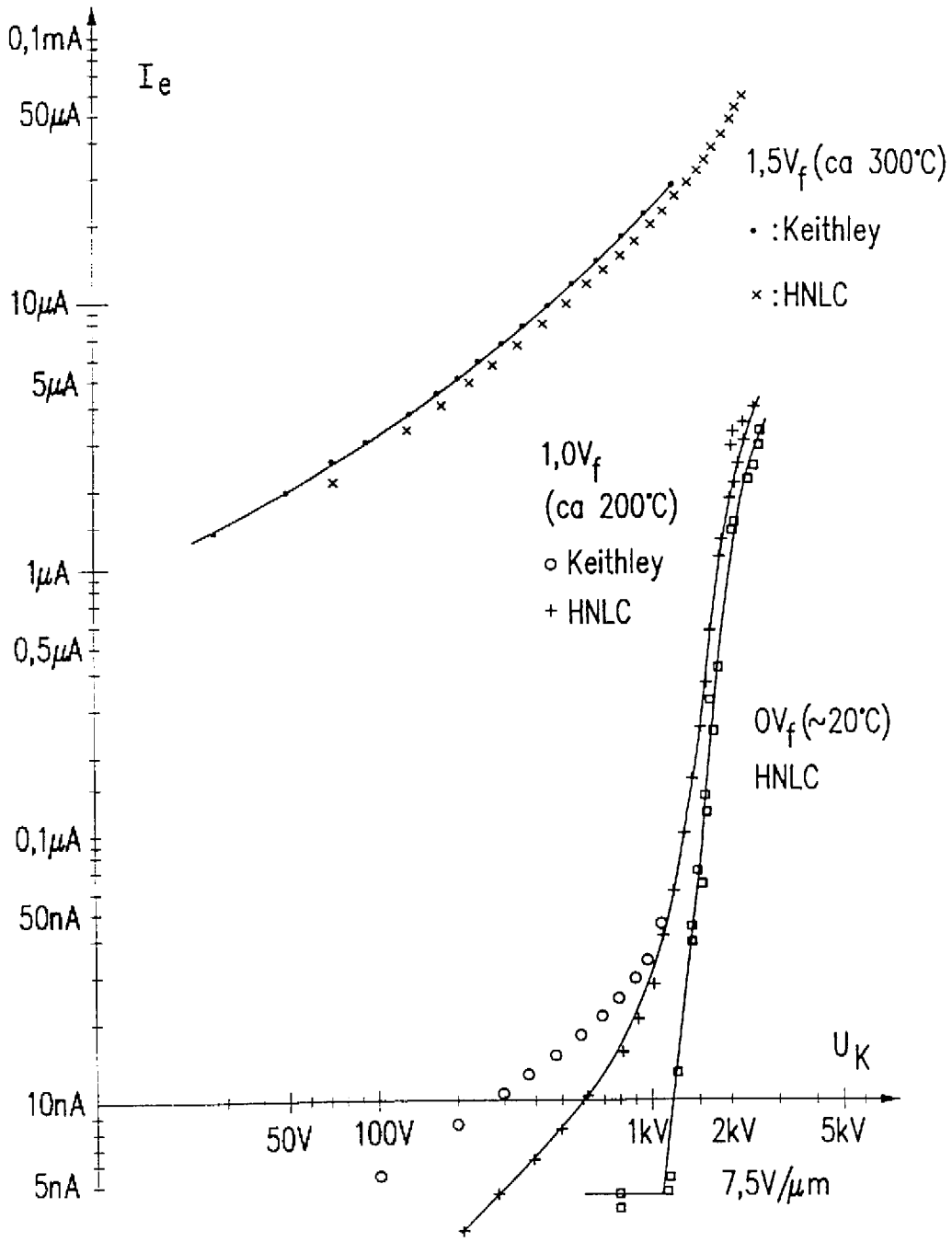
FIG. 1 shows the current-voltage characteristics of a low-temperature cathode in accordance with the invention at 300° C., 200° C. and room temperature.

An electric discharge tube or discharge lamp is composed of four functional groups, namely electron-beam generation, beam focusing, beam deflection and the fluorescent screen.

The electron-beam generating system of the discharge tubes or discharge lamps in accordance with the invention comprises an arrangement which is composed of one or more low-temperature cathodes. For example, said electron-beam generating system may be a punctiform cathode or a system composed of one or more wire cathodes, flat-strip cathodes or planar cathodes. Wire cathodes, flat-strip cathodes and planar cathodes do not have to be activated throughout their surface area, they may alternatively contain the active top coating only in individual surface segments.

The electron-beam generating system may further comprise a grid-control electrode by means of which each time one cathode of a number of cathodes in accordance with the invention or one or more surface segments of a low-temperature cathode can be controlled. An electric field strength E for which the following relationship applies: 5 $V/\mu \leq E \leq 15$ $V/\mu m$, is applied across this grid-control electrode, and the emission of these segments or individual cathodes is controlled through the change in field strength.

A flat-panel display screen in accordance with the invention can be a modified cathode-ray tube, a flat-panel display tube, or a variant thereof in the form of a field-emitter display. The invention particularly relates to a field-emitter display. Field-emitter displays are variants of cathode-ray tubes. They both employ an electron beam which is rich in energy to activate light-emitting fluorescent materials and generate an image. In conventional cathode ray tubes, a single electron beam of each of the three, rather large electron guns, that is one electron beam for each color, successively scan each of the many pixels. In contrast to this, the electron-generating system of a field-emitter display provides innumerable, small electron sources, one for each pixel.

Thus, the field-emitter display in accordance with the invention can be constructed as follows:

two glass plates, an anode plate and a cathode plate are separated from each other by spacers. The cathode plate has metallically conducting strips which are covered with a thin layer of cold-cathode material in accordance with the invention. The anode plate has similar strips, which have a transparent conductor, for example of doped tin oxide, as the base layer, and a layer containing a fluorescent material as the top coating. The anode plate and the cathode plate are interconnected by means of spacers, the cathode and anode strips, which face each other, being turned through 90° relative to each other. Both plates are connected with each other in a vacuum-tight manner. An external, electronic circuit is provided which enables each strip to be driven independently. The principle of this embodiment is that of a matrix-controlled diode.

In a different embodiment, the flat-panel display screen in accordance with the invention may be a flat-panel display tube comprising a series of linear wire cathodes which are used to generate a bundle of rays, each individual ray being associated with a small rectangular section of the display screen.

The low-temperature cathodes in accordance with the invention can be constructed as punctiform cathodes or wire cathodes. Particularly advantageous properties are achieved, however, when the cathodes in accordance with the invention are constructed as plate-shaped cathodes. For this purpose, they can be provided on a flat-strip substrate or on a plate comprising insulating strips to separate emissive cathode strips or segments from each other. Alternatively, use can be made of a construction comprising a large "emitter area".

Figure 2:
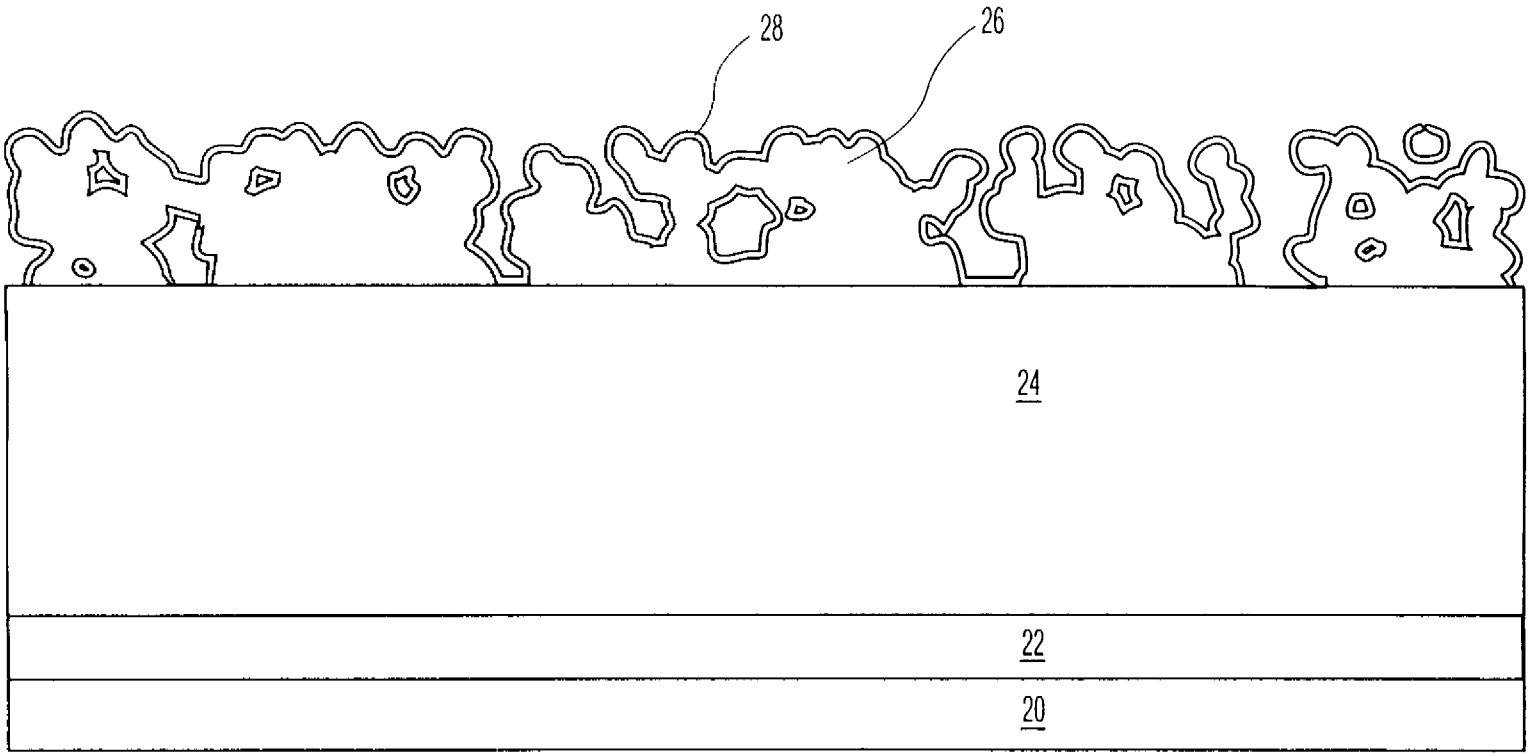
FIG. 2 shows an embodiment of a low-temperature cathode in accordance with the invention.

Referring to FIG. 2, the holder 20 may be in the form of a silicon disc or a glass plate, for example, for a field-emitter display. However, the holder may alternatively be in the form of a wire, for example, for flat display screen tubes comprising several cathode wires. In the case of punctiform cathodes, the holder may alternatively be in the form of the known metal tubes of nickel, molybdenum and the like, said holder comprising a heating coil which enables the cathode to be operated at temperatures up to 500° C., in particular at 200° C. to 300° C.

The conductive bottom layer 22 is generally made from a metal, for example tungsten. It may alternatively be composed of a number of metal layers, for example a tungsten layer and a tungsten/rhenium layer.

The substrate 24 in accordance with the invention may be a porous tungsten layer, as is known from conventional I-cathodes. Such porous tungsten layers may comprise rhenium, iridium, osmium, ruthenium, tantalum, molybdenum or scandium oxide. These percolation-structured porous layers are produced powder-metallurgically. In the pores, the layers comprise a barium compound as the barium source. Such barium compounds are, for example, oxidic barium-calcium-aluminium compounds of the general composition $xBaO_2$ $yCaO$ $zAl_2O_3$, where x=4, y=1, z=1 or x=5, y=3, z=2 or x=5, y=3, z=0. After the formation process, the top coating 26 is covered with an active surface layer 28 having a very low work function. This layer is very thin, i.e. of the order of magnitude of a monolayer, and comprises an emitter complex containing barium, scandium and oxygen.

In accordance with another embodiment of the invention, the compact, planar bottom layer is composed of tungsten containing rhenium, iridium, osmium, ruthenium, tantalum, molybdenum or scandium oxide.

In this embodiment, the substrate layer is dispensed with. The top coating comprises tungsten alloyed with rhenium, osmium and, optionally with iridium, ruthenium, tantalum and/or molybdenum. The top coating further comprises scandium oxide or scandium oxide mixed with the oxides of other rare earth metals such as europium, samarium and cerium. The top coating may alternatively be composed of scandium tungstates such as $Sc_6WO_{12}$ or $Sc_2W_3O_{12}$.

The top coating may, however, also be constructed as a multilayer, in particular a double layer, having the above-mentioned layer compositions, the best results being achieved by using a scandium-containing layer as the outer layer. This top coating further comprises a barium source, which may be a barium-containing oxidic compound such as BaO or $xBaO_2$ $yCaO$ $zA1_2O_3$, where x=4, y=1, z=1 or x =5, y=3, z =2 or x=5, y=3, z=0. These barium-containing compounds can be mixed with calcium oxide or strontium oxide.

The thickness of this top coating preferably ranges from 100 to 500 nm. The tungsten content of the top coating consists of ultrafine particles having a diameter of 1 to 50 nm which are deposited in a nano-structured layer. The other two components are also deposited as ultrafine particles and are situated partly between and partly on tungsten particles. In the activation process, the emissive surface complex, which forms the surface layer on the top coating, is formed from the three components.

The low-temperature cathodes in accordance with the invention are manufactured in a two-stage process.

It is possible to start from well-known cathode types, such as L-cathodes, I-cathodes, B-cathodes or M-cathodes and to form a hybrid from these substrates and the new top coating. Alternatively, use can be made of glass or silicon discs, which are coated with a bottom layer of a conductive material in accordance with the invention. These substrates are provided in the deposition chamber of a laser-ablation deposition device. Good results are obtained when use is made of an excimer laser which, unlike $CO_2$ lasers, can also ablate tungsten without any problem. In succession, the tungsten-containing component, the scandium-containing component and the barium-containing component are deposited. Favorable results are obtained by using multitargets containing all three components on one target arrangement. The emissive properties of the finished low-temperature cathode are favorably influenced when, during the ablation-deposition process, the gas atmosphere consists of very pure argon or argon/hydrogen. Favorable results are also obtained when the substrates for the top coating are heated during the ablation-deposition process.

In the second process step, the emitter complex is formed in the surface layer. This activation step may be a thermal, voltage-supported activation, a simple sintering process or a process in which a laser beam is used for superficial sintering.

The thermal, voltage-supported activation should take place in a vacuum. This can be carried out in a simple manner by activating the low-temperature cathode in the finished discharge tube. To this end, the cathode is heated to approximately 800° C. and a voltage is applied. The relevant current-voltage diagram also serves as a quality check.

If the top coating is composed of very fine particles having an average grain size>10 nm, the activation process may also include in a simple sintering operation at 800° C. In the case of top coatings comprising larger particles, the activation step may consist of a pulsed laser treatment at 1,000 ° C. to 1,100 ° C.

The low-temperature cathodes in accordance with the invention are characterized by an excellent emission at low temperatures, in combination with a very low work function.

FIG. 1 shows the current-voltage characteristic of low-temperature cathodes in accordance with the invention with logarithmic scale on both axes at 300° C., 200° C. and at room temperature. The temperatures are indicated as radiation temperatures; they were pyrometrically determined.

The overall emission consists of glow emission and field emission. The contribution of the glow emission in accordance with the Richardson equation $$I_0 = A_R T^2 \exp(-\phi 0/kT)$$

decreases to less than 1 nA already at 200° C. However, field emission starts at a threshold value of 1.2 kV, said field emission rapidly producing emission currents >3 $\mu$A when the field intensity is increased further. At a distance between the diodes of d=160 $\mu$m, which can be determined by means of the Child-Langmuir equation, the threshold field strength of the field emission is 7.5 V/$\mu$m, which is a very good cold emission value, which only very few other cathodes have as a peak value.

In an ALT test, a life cycle of 1,00 hours was attained.

We claim:

1. A low-temperature cathode including a holder, a conductive lower layer supported by said holder, an upper coating comprising crystallite microtips of ultrafine particles having a nanostructure, and a surface layer disposed on the nanostructure, said surface layer comprising an emission material.

2. A low-temperature cathode as in claim 1 where the emission material of the surface layer comprises at least two of the following three components:

a. a first component consisting essentially of a refractory metal material;

b. a second component selected from the group consisting of scandium, yttrium, lanthanum, actinium and their compounds;

c. a third component selected from the group consisting of alkaline earths and their compounds.

3. A low-temperature cathode as in claim 1 where the emission material of the surface layer comprises at least two of the following three components:

a. a first component consisting essentially of a tungsten material;

b. a second component consisting essentially of at least one oxidic compound of scandium;

c. a third component consisting essentially of at least one oxidic compound of barium.

4. A low-temperature cathode as in claim 1 where the upper coating also includes an emission material.

5. A low-temperature cathode as in claim 1 where the emission material has a work function lower than 2.8 eV.

6. A low-temperature cathode as in claim 1 where the ultrafine particles have a grain size in the range from 1 to 100 nm.

7. A low-temperature cathode as in claim 1 where the nanostructure of the upper coating is nanocrystalline, nanoamorphous or nanoporous and the size of the structure ranges from 1 to 1,000 nm.

* * * * *